United States Patent [19]

Roberts et al.

[11] Patent Number: 5,002,687

[45] Date of Patent: Mar. 26, 1991

[54] FABRIC WASHING COMPOSITIONS

[75] Inventors: David W. Roberts, Bebington; Peter S. Sims, Chester; David W. Thornthwaite, Neston, all of Great Britain

[73] Assignee: Lever Brothers Company, Division of Conopco, Inc., New York, N.Y.

[21] Appl. No.: 337,246

[22] Filed: Apr. 13, 1989

[51] Int. Cl.[5] ..... C11D 3/395

[52] U.S. Cl. ..... 252/174.12; 252/95; 252/96; 252/DIG. 12

[58] Field of Search ..... 252/95, 99, 102, 186.31, 252/174.12, DIG. 12

[56] References Cited

U.S. PATENT DOCUMENTS 3,723,327 3/1973 van Kampen et al. ..... 252/174.12

FOREIGN PATENT DOCUMENTS 0270133 7/1978 Fed. Rep. of Germany .
1566671 5/1980 United Kingdom .

*Primary Examiner*—Paul Lieberman

*Assistant Examiner*—John F. McNally

*Attorney, Agent, or Firm*—Milton L. Honig

[57] ABSTRACT

An improved alkaline enzymatic fabric-washing composition is disclosed comprising a surface-active material, detergency builders, an enzyme, a peroxide compound bleach and a peroxyacid bleach precursor of the formula:

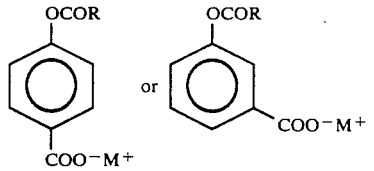

wherein R is an unsubstituted alkyl group containing 1 to 9 carbon atoms or a phenyl group; and M is hydrogen, alkali metal, alkaline earth metal, ammonium or alkyl or hydroxyalkyl substituted ammonium cation. The composition is effective for washing fabrics at the low temperature region of 40° C. and below.

4 Claims, No Drawings

FABRIC WASHING COMPOSITIONS

BACKGROUND OF THE INVENTION

1. Field of the Invention

This invention relates to fabric-washing compositions. More particularly it relates to an improved low temperature bleaching fabric-washing composition comprising a peroxide compound, a peroxyacid bleach precursor and enzymes.

2. The Related Art

It is well known that active oxygen-releasing peroxide compounds are effective bleaching agents. These compounds are frequently incorporated in detergent compositions for stain and soil removal. They have, however, an important limitation: the activity is extremely temperature-dependent. Thus, active oxygen-releasing bleaches are essentially only practical when the bleaching solution is heated above 60° C. At a bleach solution temperature of about 60° C., extremely high amounts of the active oxygen-releasing compounds must be added to achieve any bleaching effect. This is both economically and practically disadvantageous. As the bleach solution temperature is lowered below 60° C., peroxide compounds, e.g. sodium perborate, are rendered ineffective, regardless of the level of peroxide compound added to the system. The temperature dependency of peroxide compounds is significant because such bleach compounds are commonly used as a detergent adjuvant in textile wash processes that utilize an automatic household washing machine operating at wash water temperatures of below 60° C. Such wash temperatures are utilized because of textile care and energy considerations. Consequently, a constant need has developed for substances which render peroxide compound bleaches more effective at bleach solution temperatures below 60° C. These substances are generally referred to in the art as bleach precursors, promoters or activators.

Typically, the precursor is a reactive compound of the N-acyl or O-acyl type such as a carboxylic acid ester that in alkaline solution containing a source of hydrogen peroxide, e.g. a persalt, such as sodium perborate, will generate the corresponding peroxyacid, which is more reactive than peroxide compounds alone. The reaction involves nucleophilic substitution on to the precursor molecule by perhydroxide anions ($HOO^-$) and is facilitated by precursors having good leaving groups. Often this reaction is referred to as perhydrolysis. Numerous substances have been proposed in the art as effective bleach precursors, promoters or activators, such as disclosed in a series of articles by Allan H. Gilbert in Detergent Age, June 1967, pages 18–20, July 1967, pages 30–33, and August 1967, pages 26–27 and 67; and further in GB patents 836,988; 907,356; 1,003,310 and 1,519,351; German patent 3,337,921; EP-A-0185522; EP-A-0174132; EP-B-0120591; and U.S. Pat. Nos. 4,412,934 and 4,675,393.

Normally, the precursor is also a hydrolysable material which can react with moisture and alkaline components of the detergent compositions during storage, forming nonreactive products. This reaction, referred to as hydrolysis, causes loss of precursor during storage when incorporated in detergent compositions, the extent of which is highly dependent upon the ease at which the precursor undergoes the hydrolysis reaction.

Various means have been proposed in the art to protect the precursor from the aqueous and alkaline components of the detergent composition during storage. It should be appreciated, however, that the less stable to hydrolysis the precursor is the more difficult it will be to achieve adequate protection.

It is believed that this may be one reason why only a few of the large number of proposed compounds have found commercial exploitation, of which N,N,N',N'-tetraacetylethylene diamine (TAED), belonging to the type of N-acyl precursors, is the one most widely used in practice.

One drawback of TAED, however, is the sluggishness of the peroxyacid release from the reaction with the peroxide compound liberating hydrogen peroxide, such as sodium perborate, sodium percarbonate, sodium persilicate, urea peroxide and the like, resulting in a non-optimal bleaching effect. TAED can thus be classed as a slow-acting precursor, which can be incorporated in enzymatic alkaline detergent compositions without undue stability problems.

Another drawback of TAED is that its solubility in water is rather poor, i.e. somewhere in the region of 1%, which is another reason for the non-optimal bleaching performance of TAED/$H_2O_2$ systems.

With the trend towards still lower fabric-washing temperatures, to e.g. 40° C. and below, there is an incentive to improve on the bleaching performance of TAED/peroxide compound systems. One option is to replace TAED by a more reactive precursor, such as for example sodium p-acetoxybenzene sulphonate as disclosed in GB patent 846,798.

A disadvantage of such more reactive precursors, however, is that they tend to (per)hydrolyse more readily than tetraacetylethylene diamine (TAED), and hence suffer from a more severe decomposition problem during storage.

Another disadvantage of more reactive precursors is that they tend to more readily attack enzymes, especially proteolytic enzymes, which as a class is an essential ingredient in the majority of current household fabric-washing compositions.

Consequently, a constant need has developed of possibly new and better substances which render peroxide compound bleaches more effective at bleach solution temperatures in the region of from ambient to about 40° C., without the above drawbacks and disadvantages.

SUMMARY OF THE INVENTION

It has now been found that specific carboxylic acid esters as hereinafter defined are more reactive bleach precursors than TAED and yet they are surprisingly more stable to hydrolysis than sodium p-acetoxybenzene sulphonate and more enzyme-friendly, thereby rendering them suitable for use in enzymatic alkaline fabric-washing detergent compositions.

The invention therefore provides an improved alkaline fabric-washing composition comprising a surface-active material, detergency builders, a peroxide compound bleach, a peroxyacid bleach precursor and a proteolytic enzyme, characterized in that said peroxyacid bleach precursor is a carboxylic acid ester of the following specific structural formulae:

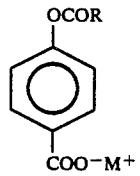

(I)

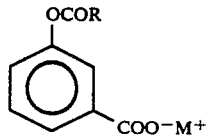

(II)

wherein R is an unsubstituted alkyl group containing 1 to 9 carbon atoms or a phenyl group; and M is hydrogen, alkali metal, alkaline earth metal, ammonium or alkyl or hydroxyalkyl substituted ammonium cation.

Preferably, R in formula (I) or (II) is an unsubstituted alkyl group containing 1 to 6 carbon atoms or a phenyl group, particularly an alkyl group containing 1 to 4 carbon atoms or a phenyl group.

Advantageously, the alkaline fabric-washing compositions of the invention comprising the peroxyacid bleach precursor described herein will have a 2–5 g/l solution pH of 8.5–10.5.

DETAILED DESCRIPTION

The use of the above noted carboxylic acid esters in bactericidal compositions is disclosed in German Patent Application No. 2 701 133. It cannot, however, be expected that these specific esters are effective bleach precursors usable and of excellent stability in enzymatic alkaline fabric-washing compositions in conjunction with a peroxide compound bleach providing improved bleaching performance upon fabrics in the lower wash temperature region of from ambient to about 40° C.

The compounds of the invention are much more reactive than TAED and are surprisingly stable upon storage both alone and when mixed with additional components in alkaline fabric-washing detergent compositions.

The following compounds are illustrative of precursors within the present invention:

(I) sodium 4-acetoxy benzoate;
(II) sodium 4-hexanoyloxy benzoate;
(III) sodium 3-acetoxy benzoate;
(IV) sodium 3-hexanoyloxy benzoate;
(V) sodium 3-benzoyloxy benzoate;
(VI) sodium 4-benzoyloxy benzoate.

Hydrogen peroxide sources are well known in the art. They include the alkali metal peroxides, organic peroxide bleaching compounds such as urea peroxide, and inorganic persalt bleaching compounds, such as the alkali metal perborates, percarbonates, perphosphates and persulphates. Mixtures of two or more such compounds may also be suitable. Particularly preferred are sodium perborate tetrahydrate and, especially, sodium perborate monohydrate. Sodium perborate monohydrate is preferred because it has excellent storage stability while also dissolving very quickly in aqueous bleaching solutions. Rapid dissolution is believed to permit formation of higher levels of percarboxylic acid which would enhance surface bleaching performance.

Typically, the molar ratio of hydrogen peroxide (or a peroxide compound generating the equivalent amount of $H_2O_2$) to precursor will range from 0.5:1 to about 20:1, preferably 1:1 to 15:1, most preferably from 2:1 to 10:1.

A detergent formulation of the invention containing a bleach system consisting of an active oxygen-releasing material and the specific carboxylic acid ester as herein defined will, in addition to surface-active materials, detergency builders and enzymes, usually also contain other known ingredients of such formulations.

In the formulation of the invention, the peroxyacid bleach precursor may be present at a level ranging from about 0.1% to 20% by weight, preferably from 0.5% to 10% by weight, particularly from 1% to 7.5% by weight, together with a peroxide bleaching compound, e.g. sodium perborate mono- or tetrahydrate, the amount of which is usually within the range of from about 2% to 40%, preferably from about 4% to 30%, particularly from about 10% to 25% by weight.

The surface-active material may be naturally derived, such as soap, or a synthetic material selected from anionic, nonionic, amphoteric, zwitterionic, cationic actives and mixtures thereof. Many suitable actives are commercially available and are fully described in literature, for example in "Surface Active Agents and Detergents", Volumes I and II, by Schwartz, Perry and Berch. The total level of the surface-active material may range up to 50% by weight, preferably being from about 1% to 40% by weight of the composition, most preferably 4% to 25%.

Synthetic anionic surface actives are usually water-soluble alkali metal salts of organic sulphates and sulphonates having alkyl radicals containing from about 8 to about 22 carbon atoms, the term alkyl being used to include the alkyl portion of higher aryl radicals.

Examples of suitable synthetic anionic detergent compounds are sodium and ammonium alkyl sulphates, especially those obtained by sulphating higher ($C_8$–$C_{18}$) alcohols produced, for example, from tallow or coconut oil; sodium and ammonium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those esters of the higher alcohols derived from tallow or coconut oil and synthetic alcohols derived from petroleum; sodium coconut oil fatty acid monoglyceride sulphates and sulphonates; sodium and ammonium salts of sulphuric acid esters of higher ($C_9$–$C_{18}$) fatty alcohol alkylene oxide, particularly ethylene oxide, reaction products; the reaction products of fatty acids such as coconut fatty acids esterified with isethionic acid and neutralized with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolyzing with a base to produce a random sulphonate; sodium and ammonium $C_7$–$C_{12}$ dialkyl sulphosuccinates; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkylbenzene sulphonates, sodium ($C_{16}$–$C_{18}$) alkyl sulphates and sodium ($C_{16}$–$C_{18}$) alkyl ether sulphates.

Examples of suitable nonionic surface-active compounds which may be used, preferably together with the anionic surface-active compounds, include in particular the reaction products of alkylene oxides, usually ethylene oxide, with alkyl ($C_6$–$C_{22}$) phenols, generally 5–25 EO, i.e. 5–25 units of ethylene oxide per molecule; the condensation products of aliphatic ($C_8$–$C_{18}$) primary or secondary linear or branched alcohols with ethylene oxide, generally 6–30 EO, and products made by condensation of ethylene oxide with the reaction products of propylene oxide and ethylene diamine. Other so-called nonionic surface actives include alkyl polyglycosides, long chain tertiary amine oxides, long chain tertiary phosphine oxides and dialkyl sulphoxides.

Amounts of amphoteric or zwitterionic surface-active compounds can also be used in the compositions of the invention, but this is not normally desired owing to their relatively high cost. If any amphoteric or zwitterionic detergent compounds are used, it is generally in small amounts in compositions based on the much more commonly used synthetic anionic and nonionic actives.

As stated above, soaps may also be incorporated in the compositions of the invention, preferably at a level of less than 25% by weight. They are particularly useful at low levels in binary (soap/anionic) or ternary mixtures together with nonionic or mixed synthetic anionic and nonionic compounds. Soaps which are used are preferably the sodium, or, less desirably, potassium salts of saturated or unsaturated $C_{10}$–$C_{24}$ fatty acids or mixtures thereof. The amount of such soaps can be varied between about 0.5% and about 25% by weight, with lower amounts of about 0.5% to about 5% being generally sufficient for lather control. Amounts of soap between about 2% and about 20%, especially between about 5% and about 10%, are used to give a beneficial effect on detergency. This is particularly valuable in compositions used in hard water when the soap acts as a supplementary builder.

The detergent compositions of the invention also contain a detergency builder. Builder materials may be selected from (1) calcium sequestrant materials, (2) precipitating materials, (3) calcium ion-exchange materials and (4) mixtures thereof.

Examples of calcium sequestrant builder materials include alkali metal polyphosphates, such as sodium tripolyphosphate; nitrilotriacetic acid and its water-soluble salts; the alkali metal salts of carboxymethyloxy succinic acid, ethylene diamine tetraacetic acid, oxydisuccinic acid, mellitic acid, benzene polycarboxylic acids, citric acid; and polyacetal carboxylates as disclosed in U.S. Pat. Nos. 4,144,226 and 4,146,495.

Examples of precipitating builder materials include sodium orthophosphate, sodium carbonate and long chain fatty acid soaps.

Examples of calcium ion-exchange builder materials include the various types of water-insoluble crystalline or amorphous aluminosilicates, of which zeolites are the best known representatives.

In particular, the compositions of the invention may contain any one of the organic or inorganic builder materials, such as sodium or potassium tripolyphosphate, sodium or potassium pyrophosphate, sodium or potassium orthophosphate, sodium carbonate or sodium carbonate/calcite mixtures, the sodium salt of nitrilotriacetic acid, sodium citrate, carboxymethyl malonate, carboxymethyloxy succinate and the water-insoluble crystalline or amorphous aluminosilicate builder materials, or mixtures thereof.

These builder materials may be present at a level of, for example, from 5% to 80% by weight, preferably from 10% to 60% by weight.

The proteolytic enzymes which are suitable for use in the present invention are normally solid, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the composition of the present invention. Examples of suitable proteolytic enzymes are the subtilisins which are obtained from particular strains of *B. subtilis* and *B. licheniformis*, such as the commercially available subtilisins Maxatase®, as supplied by Gist-Brocades N.V., Delft, Holland, and Alcalase®, as supplied by Novo Industri A/S, Copenhagen, Denmark.

Particularly suitable is a protease obtained from a strain of Bacillus having maximum activity throughout the pH range of 8–12, being commercially available e.g. from Novo Industri A/S under the registered trade names Esperase® and Savinase®. The preparation of these and analogous enzymes is described in British Patent Specification No. 1,243,784.

Other examples of suitable proteases are pepsin, trypsin, chymotrypsin, collagenase, keratinase, elastase, papain, bromelin, carboxypeptidases A and B, aminopeptidase and aspergillopeptidases A and B.

The amount of proteolytic enzymes normally used in the composition of the invention may range from 0.001% to 10% by weight, preferably from 0.01% to 5% by weight, depending upon their activity. They are generally incorporated in the form of granules, prills or "marumes" in an amount such that the final washing product has proteolytic activity of from about 2–20 Anson units per kilogram of final product.

Apart from the components already mentioned, the detergent compositions of the invention can contain any of the conventional additives in the amounts in which such materials are normally employed in fabric-washing detergent compositions. Examples of these additives include lather boosters, such as alkanolamides, particularly the monoethanol amides derived from palmkernel fatty acids and coconut fatty acids; lather depressants, such as alkyl phosphates and silicones; anti-redeposition agents, such as sodium carboxymethyl cellulose and alkyl or substituted alkyl cellulose ethers; peroxide stabilizers, such as ethylene diemine tetraacetic acid, ethylene diamine tetra (methylene phosphonic acid) and diethylene triaminepenta (methylene phosphonic acid); fabric-softening agents including clays, inorganic salts, such as sodium sulphate, and, usually present in very small amounts, fluorescent agents, perfumes, other enzymes, such as cellulases, lipases and amylases, germicides and colorants.

Other useful additives are polymeric materials, such as polyacrylic acid, polyethylene glycol and the copolymers (meth)acrylic acid and maleic acid, which may also be incorporated to function as auxiliary builders together with any of the principal detergency builders such as the polyphosphates, aluminosilicates and the like.

Generally, for reasons of improving stability and handling, the bleach precursors will advantageously be presented in the form of particulate bodies comprising said bleach precursor and a binder or agglomerating agent. Many and diverse methods of preparing such precursor particulates have been described in various patent literature documents, such as e.g. in Canadian Patent No. 1,102,966; GB Patent No. 1,561,333; U.S. Pat. No. 4,087,369; EP-A-0,240,057; EP-A-0,241,962;

EP-A-0,101,634 and EP-A-0,062,523. Each of these methods may be selected and applied to the bleach precursor of the invention.

Particulates incorporating the precursors of the present invention are normally added to the spray-dried portion of the detergent composition with the other dry-mix ingredients, such as enzymes, inorganic peroxygen bleaches and suds depressants. It will be appreciated, however, that the detergent composition to which the precursor particulates are added may itself be made in a variety of ways, such as dry-mixing, agglomeration extrusion, flaking, etc., such ways being well known to those skilled in the art and not forming part of the present invention.

In one specific embodiment, the peroxyacid precursors herein described are particularly suitable for incorporation in so-called non-aqueous liquid laundry detergent compositions containing an enzyme together with a peroxide bleaching compound, e.g. sodium perborate, to impart an effective cleaning and stain-removing capacity to the products on fabrics and textiles.

Non-aqueous liquid detergent compositions including paste-like and gelatinous detergent compositions in which the precursor compounds can be incorporated are known from the art and various formulations have been proposed, e.g. in U.S. Pat. Nos. 2,864,770; 2,940,938; 4,772,412; 3,368,977; GB-A-1,205,711; 1,270,040; 1,292,352; 1,370,377; 2,194,536; DE-A-2,233,771; and EP-A-0,028,849.

These are compositions which normally comprise a non-aqueous liquid medium with or without a solid phase dispersed therein. The non-aqueous liquid medium may be a liquid surfactant, preferably a liquid nonionic surfactant; a non-polar liquid medium, e.g. liquid paraffin; a polar solvent, e.g. polyols, such as glycerol, sorbitol, ethylene glycol, optionally combined with low-molecular monohydric alcohols, e.g. ethanol or isopropanol; or mixtures thereof.

The solid phase can be builders, alkalis, abrasives, polymers, clays, other solid ionic surfactants, bleaches, enzymes, fluorescent agents and other usual solid detergent ingredients.

EXAMPLE I

The hydrolysis of various bleach precursors was measured by using the following technique.

1 gram of sodium lauryl sulphate and 2 grams of sodium metaborate tetrahydrate were dissolved in 1000 ml of double-distilled deionised water; this solution was used in the reference cell of the spectrophotometer. To 800 ml of the stirred solution was added sufficient precursor to give an optical density of 0.4 to 0.8, and the solution was passed through a flow-cell in the spectrophotometer. The decomposition (hydrolysis) of the precursor was monitored by measuring the decrease in optical density at the wavelength of maximum absorbance.

The following bleach precursors were used:

(1) Sodium 1-benzoyloxybenzene-4-sulphonate (BOBS).
(2) Sodium p-acetoxybenzene sulphonate (SABS).
(3) Sodium 3-benzoyloxy benzoate (S-3-BOB).
(4) Sodium 4-benzoyloxy benzoate (S-4-BOB).

The results are tabulated below:

TABLE I

| Precursor | Hydrolysis rate constant (/min.) | % loss after 60 min. |
|---|---|---|
| (1) BOBS | 0.0038 | 20 |
| (2) SABS | 0.0154 | 57 |
| (3) S-3-BOB | 0.0022 | 12 |
| (4) S-4-BOB | 0.0023 | 13 |

These results confirm that the bleach precursors (3) and (4) as used in the invention are more stable to hydrolysis than the reactive esters BOBS and SABS.

EXAMPLE II

The following granular detergent composition was prepared by spray-drying an aqueous slurry:

| Composition | Parts by weight |
|---|---|
| sodium alkyl benzene sulphonate | 6.0 |
| $C_{14-15}$ alcohol/7 ethylene oxide | 7.0 |
| sodium soap | 1.6 |
| zeolite | 24.0 |
| alkaline silicate | 0.5 |
| polyacrylate | 4.0 |
| sodium carbonate | 8.0 |
| sodium carboxymethyl cellulose | 0.5 |
| ethylene diamine tetraacetate | 0.2 |
| fluorescer | 0.2 |
| salts | 0.7 |

To this base powder were added 15 parts of sodium perborate monohydrate, an amount of precursor at a molar ratio of precursor to perborate of 1:9, and 1% by weight of a proteolytic enzyme (Savinase® T40 marumes).

Bleaching tests were carried out with the finished powder formulation using different precursors, in a Tergotometer heat-up wash to 40° C. in 24° FH water at a dosage of 5 g/l. Tea-stained test cloths were used as the bleach monitor. The bleaching efficiencies were determined using an Elrepho reflectometer and the results expressed as ΔR 460* are shown in the following Table II.

TABLE II

| Precursor | ΔR 460* |
|---|---|
| (1) S-4-BOB | 5.3 |
| (2) S-3-BOB | 6.7 |
| (3) TAED | 4.5 |

These results show that both compositions of the invention containing the precursors (1) S-4-BOB and (2) S-3-BOB are superior to TAED in removing tea stains from fabrics at 40° C.

EXAMPLE III

Samples of the finished powder formulations of Example II containing perborate, enzyme and unprotected precursors were stored in open phials at 25° C. and 81% R.H. for seven days.

Enzyme activities were determined in the stored samples after seven days and compared with the freshly made samples. The results presented in Table III as percentage loss of enzyme activity were the average of duplicate storage tests:

TABLE III

| Precursor | % loss of enzyme activity |
|---|---|
| S-4-BOB | 20 |

TABLE III-continued

| Precursor | % loss of enzyme activity |
|---|---|
| S-3-BOB | 14 |
| TAED | 33 |

These test results show that the precursors used in the invention are even more compatible with the enzyme Savinase® T40 than TAED.

We claim:

1. An alkaline fabric-washing composition comprising (a) from 1 to 40% by weight of a surface-active material selected from the group consisting of soap, synthetic anionic, nonionic, amphoteric, zwitterionic and cationic active detergents and mixtures thereof;

(b) from 5 to 80% by weight of a detergency builder material;

(c) from 2 to 40% by weight of a peroxide bleaching compound;

(d) from 0.001 to 10% by weight of a proteolytic enzyme; and (e) from 0.1 to 20% by weight of a carboxylic acid ester having the following specific structural formulae:

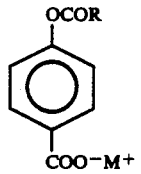

(I)

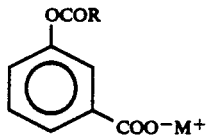

(II)

wherein R is an unsubstituted alkyl group containing 1 to 9 carbon atoms or a phenyl group; and M is hydrogen, alkali metal, alkaline earth metal, ammonium or alkyl or hydroxyalkyl substituted ammonium cation.

2. A composition according to claim 1, wherein R is an unsubstituted alkyl group containing 1 to 6 carbon atoms or a phenyl group.

3. A composition according to claim 2, wherein R is an unsubstituted alkyl group containing 1 to 4 carbon atoms or a phenyl group.

4. A method for washing fabrics comprising treating said fabrics in an aqueous medium to which is added an effective amount of a composition comprising:

(a) from 1 to 40% by weight of a surface-active material selected from the group consisting of soap, synthetic anionic, nonionic, amphoteric, zwitterionic and cationic active detergents and mixtures thereof;

(b) from 5 to 80% by weight of a detergency builder material;

(c) from 2 to 40% by weight of a peroxide bleaching compound;

(d) from 0.001 to 10% by weight of a proteolytic enzyme; and (e) from 0.1 to 20% by weight of a carboxylic acid ester having the following specific structural formulae:

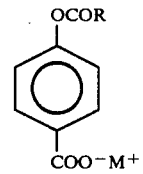

(I)

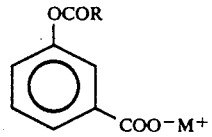

(II)

wherein R is an unsubstituted alkyl group containing 1 to 9 carbon atoms or a phenyl group; and M is hydrogen, alkali metal, alkaline earth metal, ammonium or alkyl or hydroxyalkyl substituted ammonium cation.

* * * * *